United States Patent [19]

Christensen

[11] 4,154,349

[45] May 15, 1979

[54] EXCAVATING IMPLEMENT STABILIZER

[75] Inventor: Robert B. Christensen, Kenosha, Wis.

[73] Assignee: International Harvester Company, Chicago, Ill.

[21] Appl. No.: 848,165

[22] Filed: Nov. 3, 1977

[51] Int. Cl.[2] ..... B66F 9/12

[52] U.S. Cl. ..... 414/720; 414/685; 267/41

[58] Field of Search ..... 214/143, 145 R; 267/36 R, 41, 546; 37/118 R, 118 A

[56] References Cited

U.S. PATENT DOCUMENTS

| | | | |
|---|---|---|---|
| 1,432,529 | 10/1922 | Burke | 267/41 |
| 1,973,950 | 9/1934 | Frank | 214/143 X |
| 3,045,843 | 7/1962 | Bernotas | 214/143 X |

*Primary Examiner*—Robert G. Sheridan
*Assistant Examiner*—George F. Abraham
*Attorney, Agent, or Firm*—Douglas W. Rudy; Ronald C. Kamp; F. David AuBuchon

[57] ABSTRACT

A loader bucket is provided with a plurality of leaf springs appended to the bucket for interaction with the bucket support linkage. The leaf springs impose forces on the bucket link pins preventing undesirable movement between the bucket and the support linkage when the bucket is rolled into a load transporting position.

7 Claims, 4 Drawing Figures

EXCAVATING IMPLEMENT STABILIZER

BACKGROUND OF THE INVENTION

This invention relates to attachments for use on excavating implements, specifically buckets. More specifically the attachment comprises a set of leaf spring assemblies that can be mounted to the outside of the bucket for interaction with the boom or linkage of the bucket as the bucket is rolled back into a load transport position. The invention dampens undesirable bucket motion when the host vehicle is being driven over undulating terrain.

In excavating equipment utilizing a boom mounted shovel or bucket it is often found that a portion of the load carried in the bucket may spill as the vehicle is driven across rough site terrain. The slight clearance between the bucket mounting pins and the boom pin receivers allows some rocking of the bucket which in turn may cause spilling of the load if the load is heaped in the bucket.

It has been found that the invention set forth herein has reduced these spillage problems by reducing effective clearance between the bucket and the boom at the mounting pin locations. In essence the leaf spring assemblies dampen the movement between the boom, pins, and bucket.

The closest prior art known by the inventor utilizes a rubber bumper stop on the boom to contact the bucket when it is rolled back.

SUMMARY OF THE INVENTION

At least a single leaf spring assembly is attached to the outside of an excavating bucket. The leaf spring is positioned to interact with the boom normally pivotally attached to the bucket. The leaf spring placement is such that as the bucket is rotated and elevated from a digging position to a rolled back transport position the leaf spring will be deflected by the boom to dampen any bucket shake or wobble attributable to clearances in the mounting pins. Of course a plurality of leaf spring assemblies may be affixed to the bucket for interaction with a plurality of booms.

The primary object of this invention is to minimize bucket wobble when a bucket is fully loaded and the host vehicle is traversing a construction site so as to minimize spillage of the load.

Another object of this invention is to provide a device for dampening bucket wobble that is simple and maintenance free while being effective in use.

Also an object of this invention is to provide a bucket motion dampening device that is operative without cognitive action on the part of the operator.

DETAILED DESCRIPTION OF THE INVENTION

Figure 1:
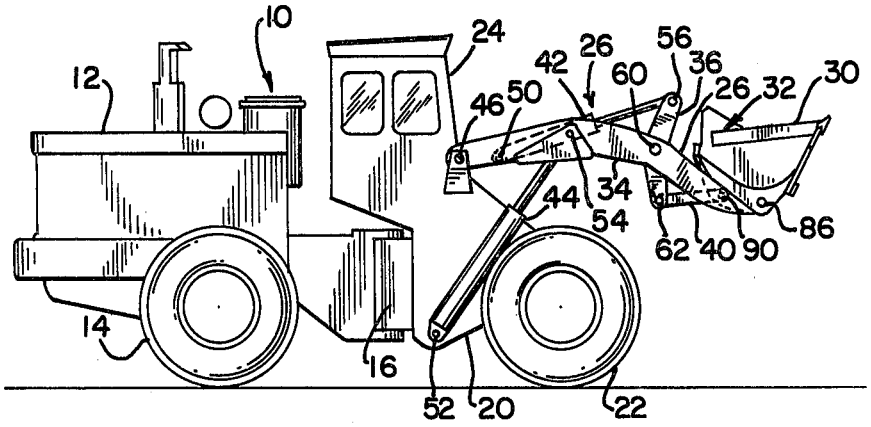
FIG. 1 is a side elevation view of an earthworking vehicle equipped with a bucket provided with the apparatus of this invention.

The vehicle shown as FIG. 1 would be typical of the type of earth-working vehicle which would advantageously use this invention. The loader shown, generally 10, has a rear engine accommodating section 12 supported on driven wheels 14 which is pivotally connected at articulation point 16 to the forward section 20. This section is also supported on driven wheels 22 while further accommodating the operator's cab 24 as well as the loader linkage and boom assembly generally 26. The bucket implement 30 is pivotally mounted to the boom assembly 26 and the bucket shown also includes the stabilizer generally 32.

The significant detail parts of the boom assembly includes (only one of each visible) a pair of booms 34, a pair of bell cranks 36, two rods 40, the bucket cylinder 42, the boom cylinders 44. Numerous pivot points are provided including boom mounting pivot point 46, bucket cylinder mount pivot points 50, boom cylinder mount pivot point 52, boom cylinder pivot point 54, bucket cylinder pivot point 56, bell crank pivot point 60, rod mount pivot points 62, bucket mount pivot point 86, and rod-bucket pivot point 90.

Figure 2:
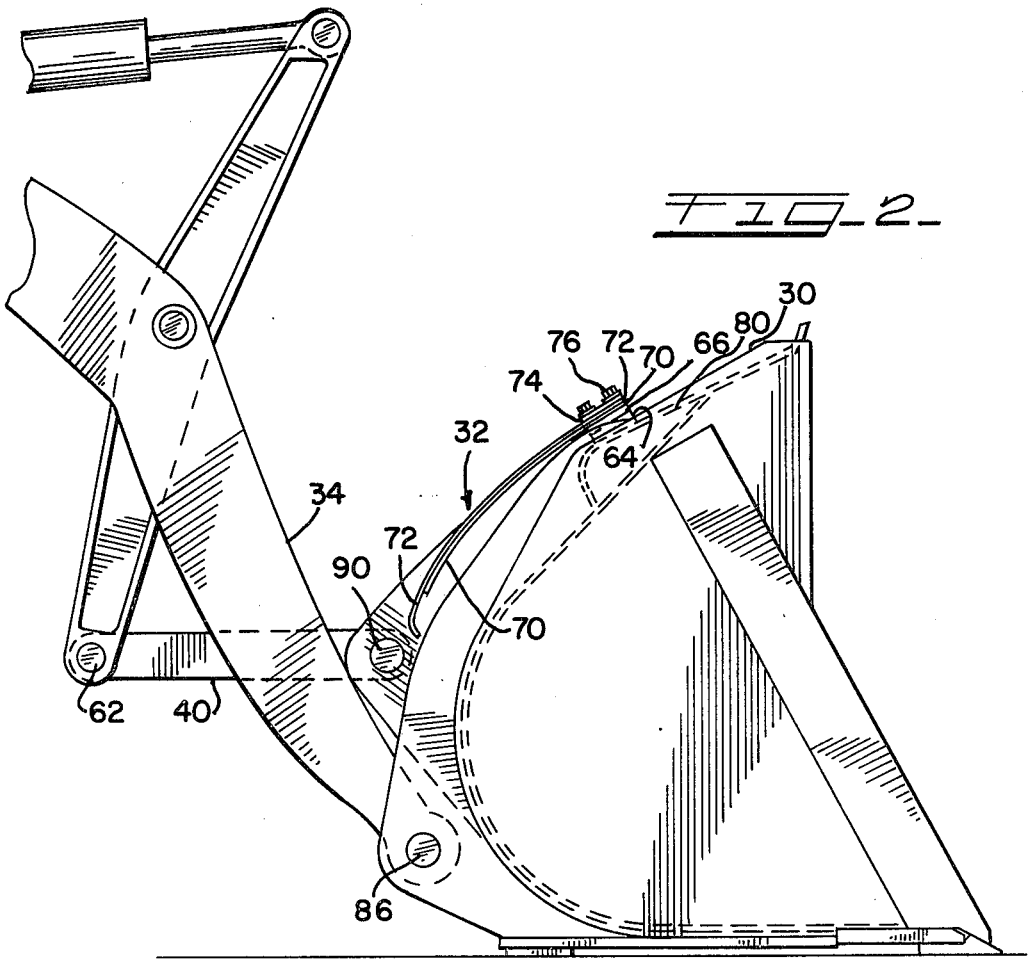
FIG. 2 is a side elevation view of a bucket and a portion of a boom assembly.
Figure 3:
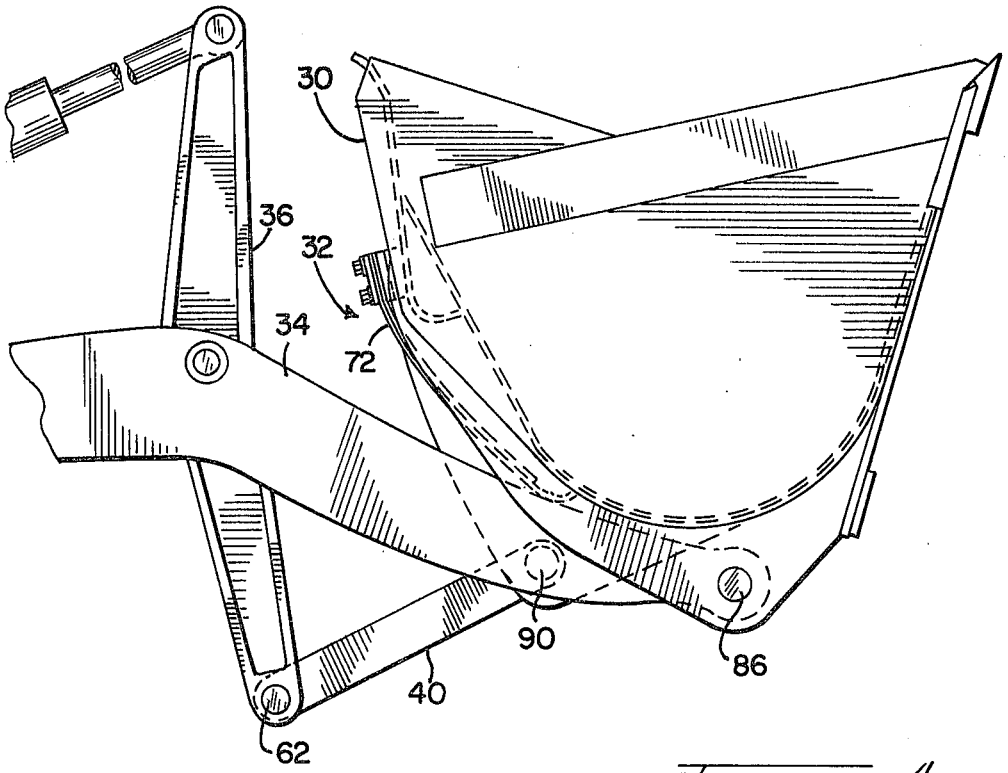
FIG. 3 is a side elevation view of a bucket and a portion of a boom assembly with the bucket in a transport position.
Figure 4:
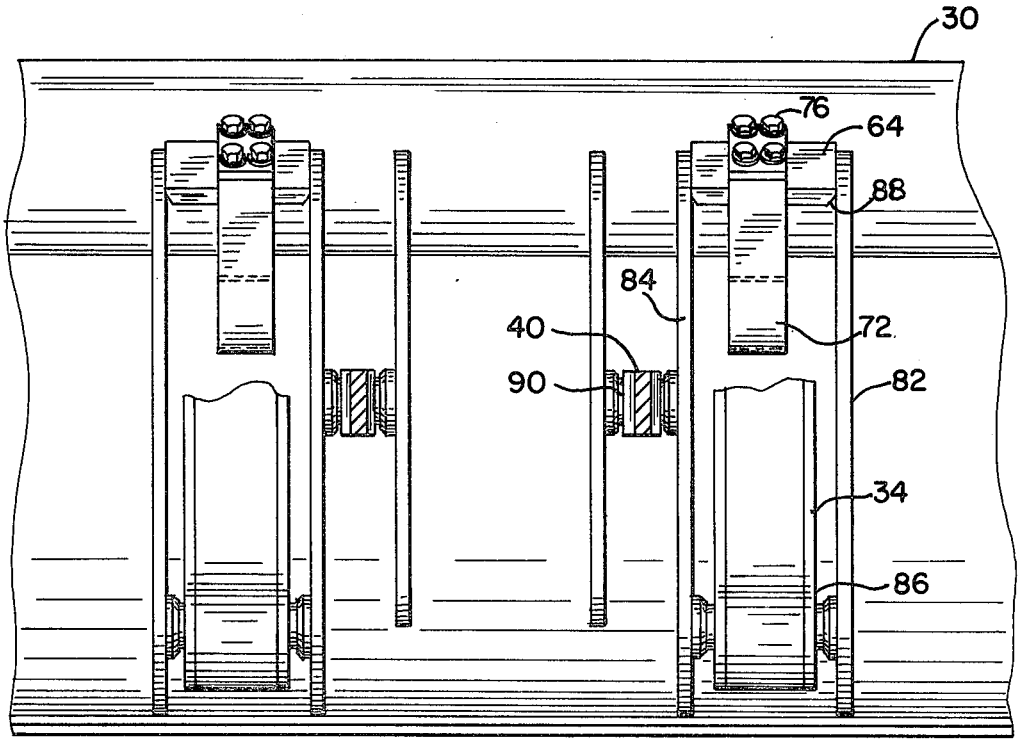
FIG. 4 is an elevation view of the backside of the bucket and a portion of the boom linkage.

FIGS. 2, 3, and 4 clearly present the invention and its associated environment. In FIG. 2 the bucket 30 is positioned in a position for being loaded. Notice that the excavating bucket is conventional except for the provision of the stabilizer. The bucket has a flat floor portion with a leading edge and a curved back wall portion integral with the floor that extends upward to a top. The bucket side walls extend vertically from the floor to the top while a bucket support 80 extends transversely along the top portion of the bucket between the side walls. A pair of boom attachment flange means, each pair including an inboard 84 and an outboard 82 boom attachment flange having bucket mount pivot point means at the lower ends thereof are attached to the back wall of the bucket. The stabilizer is fixed to the bucket support between the flanges which define planes generally perpendicular to the back of the bucket within which the stabilizer is located. Notice that the stabilizer, generally 32, which includes a bar 64 having a plurality of threaded apertures, a spacing block 66 having a plurality of apertures aligned with the threaded apertures of the bar, the spacing block positioned on the bar 64, an inner leaf spring 70 having a plurality of apertures at one end thereof positioned to be in alignment with the threaded apertures of the bar, the inner leaf spring positioned on the spacing block 66, a contact leaf spring 72 having a plurality of apertures aligned with the apertures of the inner leaf spring 70 at one end thereof, the contact leaf spring 72 positioned on top of the inner leaf spring, a top block 74 having a plurality of apertures aligned with the apertures of the contact leaf spring, the top block positioned on top of the contact leaf spring and a plurality of screw type fasteners such as 76 is carried on the bucket support 80. The bar 64 would typically be welded to the bucket support 80 and the other components of the stabilizer would be attached to the bar by the means of the fasteners 76. The contact leaf spring may be longer than the inner leaf spring 70 and would also be provided with a curved end portion at the non-apertured end thereof as shown in FIGS. 2 and 3. The threaded fasteners 76 pass through the aligned apertures of the top block, both leaf springs, the spacing block and threadably engage the bar 64, thus making the stabilizer a unified structure. In FIG. 4, the bar 64 is clearly seen in its mounted position between outboard 82 and inboard 84 boom attachment flanges. The bar is generally rectangular in shape with a length several times greater than its width. The lower end portions of the bar may be chamfered at 88 to clear weldments attaching the boom attachment flanges to the backside of the bucket. The bar will also be provided with four tapped holes to accommodate the screw fasteners 76.

Returning to FIGS. 2, 3 and 4 the common elements shown in each view will be identified in describing the function of the stabilizer. As the boom 34 is raised from the dig position of FIG. 2 to the transport position of FIG. 3 the bucket 30 will be rolled back around bucket mount pivot point 86. The rod 40, operating between the rod-bucket pivot point 90 and the rod mount pivot point 62, will dictate the position of the bucket which, of course, will be determined by the relative angular displacement of the bell crank 36 and the boom 34. The stabilizer, generally 32, and particularly the contact leaf spring 72 will come in contact with the boom 34 at the beginning of the roll back operation and will maintain contact therewith as the bucket is rolled back to the transport position. In this position the loaded bucket is held steady so that there is a minimum of spillage when roading a load to a dump site.

The drawing figures show the operation of the invention in one embodiment, however, several other alternative nuances of design are possible. For instance in FIG. 3 the contact leaf spring 72 appears to be in only limited contact with the boom 34. Alternative to this configuration would be a contact leaf spring that would be in contact with the boom for a more significant part of its length. Typically this leaf spring could be designed to have a contact area of six to eight inches or more being in contact with the boom.

Also, a viable alternative would be to vary the number of stabilizer assemblies on the bucket to correspond to the number of boom arms in contact with the bucket. Certainly providing either more or fewer leaf springs are contemplated by the invention.

It is apparent that the invention set forth in this specification fully satisfies the objects, aims and advantages set forth above. As pointed out it is evident that many alternatives, modifications, and variations will be apparent to those skilled in the art in light of the foregoing disclosure. Accordingly, this invention is intended to embrace all such alternatives and nuances of design that fall within the spirit and broad scope of the appended claims.

What is claimed is:

1. A stabilizer for attachment to the back side of an excavating implement, namely a bucket pivotally carried on a boom, said stabilizer comprising:

a bar having a plurality of threaded apertures therein, said bar being generally rectangular in shape with a length several times greater than its width and further having the bottom end portions chamfered;

a spacing block having a plurality of apertures aligned with said threaded apertures of said bar, said spacing block positioned on top of said bar;

an inner leaf spring having a plurality of apertures aligned with said apertures of said spacing block at one end of said inner leaf spring, said inner leaf spring positioned on top of said spacing block;

a contact leaf spring having a plurality of apertures aligned with said apertures of said inner leaf spring at one end thereof, said contact leaf spring longer than said inner leaf spring and having a curved end portion at a non-apertured end thereof, said contact leaf spring positioned on top of said inner leaf spring;

a top block having a plurality of apertures aligned with said apertures of said contact leaf spring, said top block positioned on top of said contact leaf spring;

a plurality of threaded fasteners passing through said apertures of said top block, both of said leaf springs, said spacing block and being threadably engaged with said bar, whereby said stabilizer is unified into a unified structure.

2. In an excavating assembly having a forward extending boom to which an excavating bucket is pivotally attached at a bucket mount pivot point and is provided with actuation mechanisms for pivoting said excavating bucket around said bucket mount pivot point toward said boom, an excavating bucket stabilizer said bucket when it is pivoted back toward said boom to a point where said stabilizer contacts said boom, said stabilizer comprising:

a bar having a plurality of threaded apertures therein, said bar fixedly attached to the back side of said bucket;

a spacing block having a plurality of apertures therethrough alignable with said threaded apertures of said bar said spacing block positioned on top of said bar;

a contact leaf spring having a plurality of apertures therethrough alignable with said apertures of said spacing block, said contact leaf spring contacting said boom when said bucket is pivoted toward said boom back around said bucket mount pivot point;

a top block having a plurality of apertures alignable with said apertures of said contact leaf spring, said top block positioned on top of said contact leaf spring;

a plurality of threaded fasteners passing through said apertures of said top block, said contact leaf spring, said spacing block and into said threaded apertures of said bar whereby said excavating bucket stabilizer is attached to said bucket.

3. The invention in accordance with claim 2 wherein said contact leaf spring is provided with a curved end portion at one end thereof and said apertures are clustered at the other end thereof.

4. The invention in accordance with claim 2 wherein said bar is an elongated rectangular plate having a length several times greater than its width arranged such that the longitudinal dimension is perpendicular to the longitudinal dimension of said contact leaf spring and further having the bottom end portions chamfered.

5. The invention in accordance with claim 2 wherein four screw type fasteners are provided to maintain said bar, spacing block, leaf spring and top block of said stabilizer together.

6. An excavating bucket for pivotable mounting on a boom, said bucket, having a flat floor portion with a leading edge, a curved back wall portion integral with said floor portion, said back wall portion extending upwardly to a top portion, a pair of bucket side walls extending vertically from said flat floor portion to said top portion, a bucket support extending transversely along said top portion of said bucket and attached to each of said pair of side walls, a pair of boom attachment flange means, each of said pair including an inboard and an outboard flange having bucket mount pivot point means at the lower end thereof, the improvement comprising:

each attachment flange means having a stabilizer fixed to said bucket support between said inboard and outboard flanges of said bucket said stabilizer having a curved leaf spring extending longitudinally from said bucket support toward said bucket mount pivot point means while being laterally located between planes defined by said inboard and outboard flanges.

7. The invention in accordance with claim 6 wherein said stabilizers may contact said boom when said bucket is attached through said bucket mount pivot point means to said boom and said bucket is pivoted back toward said boom.

* * * * *